US005400432A

United States Patent [19]

Kager et al.

[11] Patent Number: 5,400,432

[45] Date of Patent: Mar. 21, 1995

[54] APPARATUS FOR HEATING OR COOLING OF FLUID INCLUDING HEATING OR COOLING ELEMENTS IN A PAIR OF COUNTERFLOW FLUID FLOW PASSAGES

[75] Inventors: Thomas M. Kager, Racine; John V. Goelzer, Cedarburg, both of Wis.

[73] Assignee: Sterling, Inc., Milwaukee, Wis.

[21] Appl. No.: 68,621

[22] Filed: May 27, 1993

[51] Int. Cl.[6] ..... F24H 1/00; H05B 3/78

[52] U.S. Cl. ..... 392/492; 392/485; 392/450; 165/160

[58] Field of Search ..... 392/485–493, 392/450; 165/161, 160, 140

[56] References Cited

U.S. PATENT DOCUMENTS

| | | | |
|---|---|---|---|
| 1,095,165 | 4/1914 | Ockel | 165/140 |
| 1,356,818 | 10/1920 | Hadaway | 392/492 X |
| 1,524,595 | 1/1925 | Sward | 165/161 |
| 1,624,843 | 4/1927 | McQuinn . | |
| 1,688,796 | 10/1928 | Baker . | |
| 1,925,784 | 9/1933 | Williams . | |
| 2,127,732 | 8/1938 | Heitman | 165/160 |
| 2,145,084 | 1/1939 | Hersey | 165/160 X |
| 2,386,949 | 10/1945 | Hayward | 392/450 |
| 2,686,863 | 8/1954 | Chandler . | |
| 3,270,182 | 8/1966 | Hynes . | |
| 3,968,346 | 7/1976 | Cooksley . | |
| 4,085,308 | 4/1978 | Youngquist . | |
| 4,386,261 | 5/1983 | Berglund et al. . | |
| 4,395,618 | 7/1983 | Cunningham . | |
| 4,461,950 | 7/1984 | Curless et al. . | |
| 4,563,571 | 1/1986 | Koga et al. . | |
| 4,584,463 | 4/1986 | Klages et al. . | |
| 4,762,980 | 8/1988 | Insley . | |
| 4,808,793 | 2/1989 | Hurko . | |

FOREIGN PATENT DOCUMENTS

| | | | |
|---|---|---|---|
| 222953 | 5/1985 | Germany | 392/492 |
| 253721 | 1/1988 | Germany | 392/492 |
| 47-48543 | 12/1972 | Japan | 392/492 |
| 59-115931 | 7/1984 | Japan | 392/492 |

*Primary Examiner*—John A. Jeffery

*Attorney, Agent, or Firm*—Andrus, Sceales, Starke & Sawall

[57] ABSTRACT

A heating or cooling vessel for heating or cooling a fluid as it flows through the vessel includes an outer tubular shell and an inner tubular member mounted to the outer tubular shell. The inner tubular member includes a central passage defining a first flow path, and a space between the inner tubular member and the outer shell defines a second flow path which communicates with the first flow path at one end of the inner tubular member. A seal member is provided toward the opposite end of the inner tubular member, for cutting off communication between the first flow path and the second flow path. An inlet provides cool fluid to the first flow path, and the fluid circulates through the first flow path and into the second flow path for discharge through an outlet in communication with the second flow path. Heating or cooling elements are disposed in both the first and second flow paths, and are arranged to provide optimal exposure of the fluid to the heating or cooling elements during flow of fluid through the vessel to maximize the velocity at which the fluid is capable of passing through the vessel and thereby the volume of fluid heated or cooled during flow of fluid through the vessel.

6 Claims, 2 Drawing Sheets

APPARATUS FOR HEATING OR COOLING OF FLUID INCLUDING HEATING OR COOLING ELEMENTS IN A PAIR OF COUNTERFLOW FLUID FLOW PASSAGES

BACKGROUND AND SUMMARY

This invention pertains to a system for heating or cooling a fluid, and more particularly to a fluid heating or cooling system in which the fluid is heated or cooled during fluid flow.

Various systems are known for heating or cooling a fluid during flow of the fluid through a flow path in a vessel. In particular, numerous prior patents disclose complicated serpentine flow paths in a vessel through which the fluid flows, and arrangement of heating or cooling elements within the fluid flow path. In such systems, the construction of the vessel is relatively complicated, resulting in a relatively high cost of manufacture. Further, such systems typically require that the fluid flow at a relatively low velocity in order to heat or cool the fluid to the desired temperature, resulting in a less than optimal output of heated or cooled fluid.

It is an object of the present invention to provide a vessel for heating or cooling a fluid which is simple in its construction and operation, providing a relatively low cost of manufacture. It is further object of the invention to provide such a vessel in which the heating or cooling elements are arranged to provide optimum exposure of the fluid to the heating or cooling elements, enabling the fluid to be circulated through the vessel at a relatively high velocity to increase the output of heated or cooled fluid from the vessel. Yet another object of the invention is to provide a fluid heating or cooling vessel in which the heating or cooling elements are easily removed for service or replacement.

In accordance with one aspect of the invention, an assembly for heating or cooling a fluid consists of an outer tubular shell which defines first and second ends and one or more side walls, and an inner tubular member mounted within the outer tubular shell. The inner tubular member also defines first and second ends and one or more side walls. The inner tubular member defines an internal passage forming a first flow path, and a space between the side walls of the inner tubular member and the side walls of the outer tubular shell forms a second flow path. The first and second flow paths are in communication with each other adjacent one of the ends of the inner tubular member. A first inlet/outlet opening is in communication with the first flow path and isolated from the second flow path, and a second inlet/outlet opening is in communication with the second flow path and isolated from the first flow path. A series of fluid heating or cooling elements are disposed in the first flow path, and likewise a series of second fluid heating or cooling elements are disposed in the second flow path. Fluid is introduced through one of the inlet/outlet openings and flows through the first and second flow paths, and is heated or cooled by the fluid heating or cooling elements during fluid flow. The heated or cooled fluid is then discharged through the second inlet/outlet opening.

In accordance with other aspects of the invention, the first end of the inner tubular member is spaced from the first end of the outer tubular shell, and a seal member is located toward the first end of the inner tubular member between the inner tubular member and the outer tubular shell for cutting off communication between the first and second flow paths. A first end plate is mounted to the first end of the outer tubular shell, and cooperates with the seal member and the one or more side walls of the outer tubular member to define an inlet/outlet chamber. The first inlet/outlet opening is formed in the outer tubular shell, and communicates through the inlet/outlet chamber with the first flow path. A second end plate is mounted to the second end of the outer tubular shell and is spaced from the second end of the inner tubular member. The second end plate and the one or more side walls of the outer tubular shell cooperate to define a transfer chamber in the space between the end plate and the second end of the inner tubular member, for establishing communication between the first and second flow paths. The plurality of first and second fluid heating or cooling elements are mounted to the second end plate, and extend from the second end plate into the first and second flow paths. In one form, the fluid heating or cooling elements are in the form of heater elements which extend throughout a majority of the length of the first and second flow paths.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
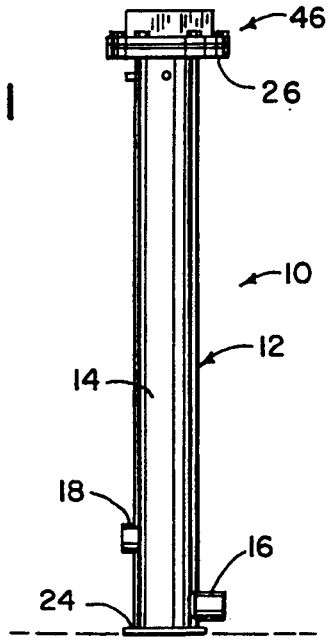
FIG. 1 is a side elevation view showing a fluid heating vessel constructed according to the invention for imparting heat to a fluid as the fluid flows through the vessel.
Figure 3:
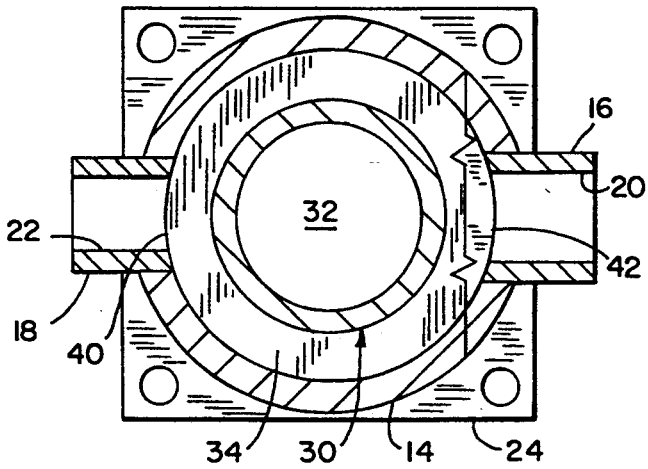
FIG. 3 is a section view taken along line 3—3 of FIG. 2.

FIG. 1 illustrates a fluid heating vessel 10, which is adapted for use in any fluid system in which it is desired to heat a fluid as the fluid flows through the vessel. For example, vessel 10 may be incorporated into a water circulating temperature control system such as is employed in an injection molding system, wherein it is desired to maintain a processing medium for the molding dies at a predetermined desired temperature. Such a system is available for Sterling, Inc. of Milwaukee, Wis., the assignee of the present invention, in the form of its STERLCO® 9000 series temperature control system.

Figure 2:
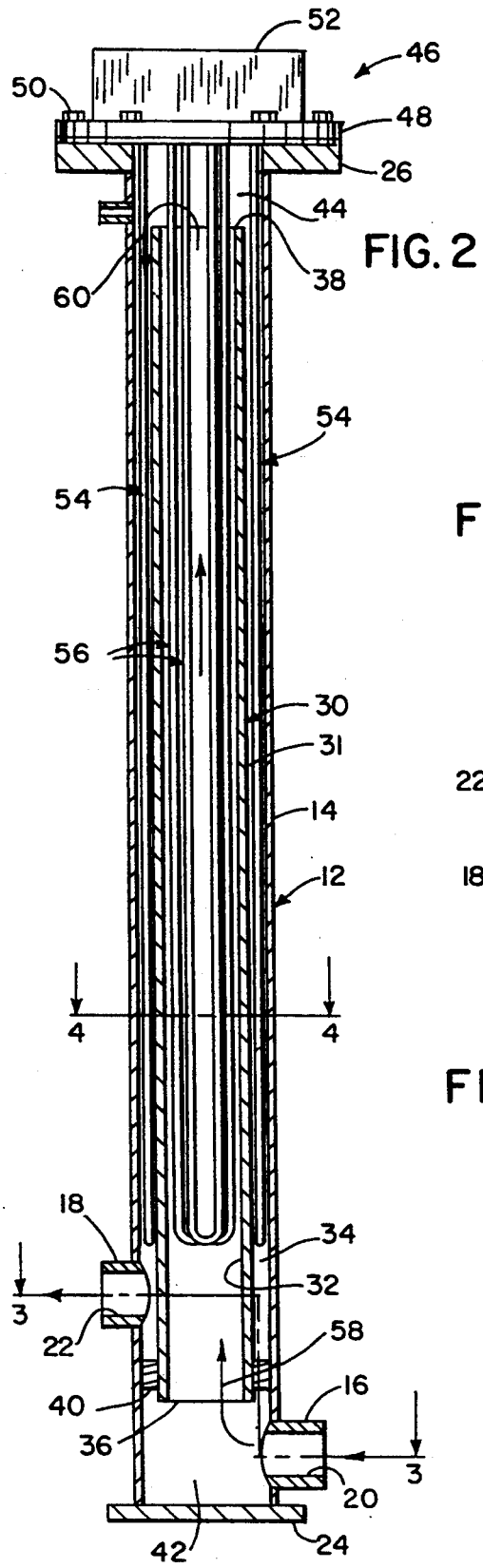
FIG. 2 is a longitudinal section view of the fluid heating vessel of FIG. 1.

Generally, vessel 10 includes an outer tubular cylindrical shell 12 defining an upper end and a lower end. Shell 12 defines a side wall 14. An inlet nipple 16 is mounted to shell 12 toward its lower end, and an outlet nipple 18 is mounted to shell 12 at a location spaced upwardly from inlet nipple 16. Referring to FIG. 2, inlet nipple 16 defines an internal passage 20, and outlet nipple 18 defines an internal passage 22. A lower end plate 24 is mounted to the lower end of outer shell 12 in a conventional manner, such as by welding or the like.

An upper mounting flange 26 is mounted to outer shell side wall 14 in a conventional manner, again such as by welding.

Referring to FIG. 2, an inner tubular member 30 is mounted within the internal passage defined by outer tubular shell 12. Inner tubular member 30 defines a side wall 31 and an internal passage 32 which forms a first flow path for fluid through vessel 10. An annular space 34 is formed between the outer surface of inner tubular member side wall 31 and the inner surface of outer shell side wall 14. Space 34 defines a second flow path for fluid through vessel 10. As shown in FIG. 2, inner tubular member 30 defines a lower end 36 and an upper end 38.

A ring-shaped seal member 40 is mounted toward lower end 36 of inner tubular member 30 such as by welding or the like. Inner tubular member 30 and ring 40 are inserted into the open lower end of outer shell 12, and the outer lower circumference of ring 40 is welded to the inner surface of outer shell side wall 14 for fixing inner tubular member 30 relative to outer shell 14. Seal member 40 thus functions to cut off communication between the first flow path defined by internal passage 32 of inner tubular member 30 and the second flow path defined by the space 34 between inner tubular member 30 and outer shell 12, and to isolated inlet nipple passage 20 from outlet nipple passage 22. Once lower end plate 24 is mounted to the lower end of outer shell 14, an inlet chamber 42 is defined by lower plate 24 in combination with the lower end of outer shell side wall 14 and seal member 40. Inlet chamber 42 establishes communication at the lower end of vessel 10 between inlet nipple passage 20 and the first flow path defined by internal passage 32 of inner tubular member 30.

An upper transfer chamber 44 is located above upper end 38 of inner tubular member 30. Transfer chamber 44 functions to establish communication at the upper end of vessel 10 between the first flow path defined by internal passage 32 of inner tubular member 30 and the second flow path defined by space 34 between inner tubular member 30 and outer shell 14.

A heater assembly, shown generally at 46, is connected to mounting flange 26 at the upper end of vessel 10. Heater assembly 46 consists of a plate 48 secured to mounting flange 26 via a series of bolts 50, an electrical junction box 52, and a series of depending outer heating elements 54 and inner heating elements 56.

Figure 4:
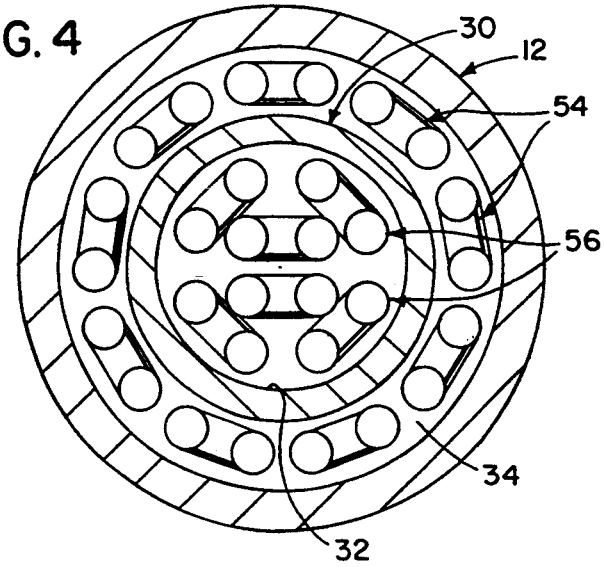
FIG. 4 is a section view taken along line 4—4 of FIG. 2.

Referring to FIGS. 2 and 4, heater elements 54 and 56 are substantially identical in construction, each comprising a pair of spaced parallel legs interconnected by a curved lower end portion, to define an elongated U-shape. Heater elements 54 and 56 are connected at their upper ends to plate 48 and with junction box 52. In a conventional manner, a resistive heating coil extends throughout the length of each of heater elements 54, 56 for imparting heat to elements 54 and 56 in response to operation of heater unit 52.

As shown in FIG. 2, heater elements 54, 56 are relatively long, extending the majority of the length of the flow paths defined by passage 32 and space 34. Illustratively, the overall length of vessel 10 is approximately 48 inches, and the overall length of inner tubular member 30 is approximately 40 inches. Heating elements 54, 56 are approximately 40 inches in length, which results in elements 54, 56 extending approximately 36 inches downwardly into the flow paths defined by passage 32 and space 34. As noted previously, passage 32 is approximately 40 inches in length, and space 34 is approximately 38 inches in length. Heater elements 54, 56 thus extend throughout approximately ninety percent of the length of the flow path defined by passage 32 and ninety-five percent of the length of the flow path defined by space 34.

Referring to FIG. 4, outer heater elements 54 are arranged in a circular pattern, and are evenly spaced about the periphery of space 34 between inner tubular member 30 and the inner surface of outer shell side wall 31. Inner heater elements 56 are arranged in a pattern of two central heater elements 56 surrounded by four heater elements 66 arranged at an angle relative to each other and to the central heater elements 56. This arrangement of heater elements 54 and 56 provides maximum exposure of the surface area of heater elements 54 and 56 to the fluid as the fluid flows through the flow paths defined by passage 32 and space 34.

In operation, vessel 12 functions as follows. A fluidic process medium, such as oil, water or other fluid, is introduced to vessel 10 through inlet nipple passage 20, passing into inlet chamber 42 and upwardly into the first flow path defined by passage 32, in the direction of arrow 58 (FIG. 2). The fluid flows upwardly through the flow path defined by passage 32, being exposed to inner heater elements 56 to heat the fluid as it passes upwardly through passage 32. At the upper end of inner tubular member 30, the fluid enters transfer chamber 44, and then passes downwardly into the flow path defined by space 34 between inner tubular member side wall 31 and the inner surface of outer shell side wall 14, in the direction of arrow 60 (FIG. 2). In transfer chamber 44, the fluid is subjected to heat provided by the upper ends of heater elements 54 and 56. As the fluid passes downwardly through the flow path defined by space 34, the fluid is exposed to the surfaces of outer heater elements 54, to further impart heat to the fluid. From space 34, the heated fluid is discharged through outlet nipple passage 22, for subsequent reintroduction into the fluidic process.

While nipple 16 and its passage 20 and nipple 18 and its passage 22 have been referred to as inlet and outlet nipples and passages, respectively, it is understood that nipple 18 could be used as the inlet and nipple 16 used as the outlet. This arrangement would also function to satisfactorily heat the liquid as it circulates through vessel 10. It is further understood that heater elements 54 and 56 could be in the form of heat exchange cooling elements for cooling a fluid as it flows through vessel 10.

An advantage to the construction and operation of vessel 10 as described is that, as the fluid passes upwardly through passage 32 of inner tubular member 30 and is being heated by inner heater element 56, the heated side wall of inner tubular member 30 functions along with inner heater elements 56 to impart heat to the fluid. This provides efficiency in operation of vessel 10.

Illustratively, outer shell 12 may be formed of a metal pipe having a nominal outside diameter of 5.0 inches and an 11 gauge wall thickness. Inner tubular member 30 may be formed of a metal pipe having an outside diameter of 3.25 inches and a 5/16 inch wall thickness. Space 34 thus is approximately 0.91 inches in width. The tubular stock from which heater elements 54, 56 are formed is approximately 0.43 inches in diameter, and the parallel spaced legs of each of heater elements 54, 56 are spaced approximately 0.742 inches apart from center-to-center of the spaced legs.

The layout of heater elements 54, 56 and the design of vessel 10 provides a heating watt density in the flow path defined by space 34 of approximately 12.34 watts per square inch. Heater elements 56 in the flow path defined by passage 32 provide a watt density of approximately 18.8 watts per square inch. This allows a relatively high rate of fluid flow through vessel 10, resulting in optimal output of heated fluid.

Figure 5:
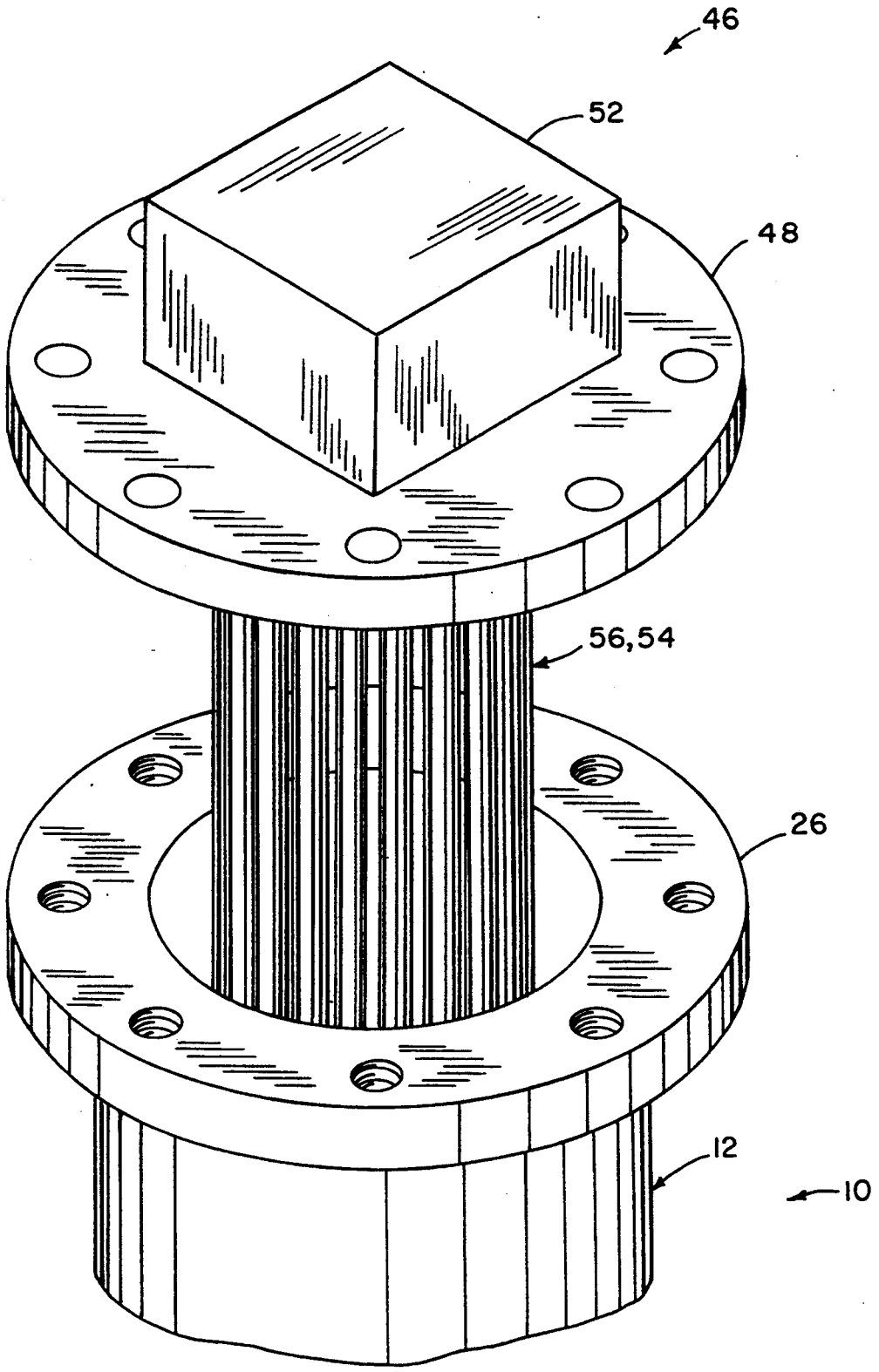
FIG. 5 is a partial exploded isometric view showing the manner in which the heater elements are installed in the fluid heating vessel of FIG. 1.

FIG. 5 illustrates the manner in which heater assembly 46 is removed and reinstalled on vessel 10 for facilitating ease of service and replacement of heater assembly 46. The modular construction of heater assembly 46, in which junction box 52 and heater element 54 and 56 are mounted to plate 48, simply requires an operator to install or remove bolts 50 in order to mount or remove heater assembly 46 to and from vessel 10.

While vessel 10 has been described as a fluid heating vessel, it is to be understood that vessel 10 could also satisfactorily be employed to cool a fluid. To accomplish this, heater elements 54, 56 are replaced with tubular fluidic heat exchanger elements having the same shape as heater elements 54, 56, and a heat exchanger water box is mounted to plate 48 in place of junction box 52. This construction provides efficient cooling of fluid as the fluid flows through vessel 10, and affords the same modular removal and replacement of elements as described.

Various alternatives and embodiments are contemplated as being within the scope of the following claims particularly pointing out and distinctly claiming the subject matter regarded as the invention.

We claim:

1. An assembly for heating or cooling a fluid, comprising:

an outer tubular shell defining a first closed end and a second open end and at least one side wall;

an inner tubular member mounted within the outer tubular shell, the inner tubular member defining first and second ends and at least one side wall, wherein the inner tubular member defines an internal passage forming a first flow path, and wherein a space is defined between the at least one inner tubular member side wall and the at least one outer tubular shell side wall to form a second flow path, wherein the first and second flow paths are in communication with each other adjacent at least one of the ends of the inner tubular member;

a first inlet/outlet in communication With the first flow path and isolated from the second flow path;

a second inlet/outlet in communication with the second flow path and isolated from the first flow path:

wherein the first end of the inner tubular member is spaced from the first end of the outer tubular shell, and further comprising a seal member located toward the first end of the inner tubular member for cutting off communication between the first and second flow paths, wherein the first inlet/outlet is formed in the outer tubular shell and communicates with the first flow path through an inlet/outlet volume defined by a space between the first end of the inner tubular member and the first end of the outer tubular shell, wherein the seal member at least in part defines the inlet/outlet volume and wherein the inlet/outlet volume is disposed between the first inlet/outlet and the first flow path;

a temperature adjusting unit removably mounted to and closing the open second end of the outer tubular shell, including a plurality of first fluid temperature adjusting elements carried thereby and disposed in the first flow path and a plurality of second fluid temperature adjusting elements carried thereby and disposed in the second flow path, wherein the first and second fluid temperature adjusting elements are removed from the first and second flow paths, respectively, by the removal of the temperature adjusting unit from the second end of the outer tubular shell;

wherein the fluid is introduced through one of the inlet/outlet openings and flows through the first and second flow paths and is discharged through the other of the inlet/outlet openings, wherein the first and second fluid temperature adjusting elements function to alter the temperature of the fluid as the fluid flows through the first and second flow paths.

2. The assembly of claim 1, wherein the first inlet/outlet opening defines the inlet and the second inlet/outlet opening defines the outlet, whereby fluid flows first through the first flow path and subsequently through the second flow path.

3. The assembly of claim 2, wherein the first end of the outer tubular shell is closed by means of an end plate mounted thereto for cooperating with the seal member and the at least one side wall of the outer tubular shell to define the inlet/outlet volume for receiving fluid between the first inlet/outlet opening and the first end of the inner tubular member.

4. An assembly for heating or cooling a fluid, comprising:

an outer tubular shell defining a first closed end and a second open end and at least one side wall;

an inner tubular member mounted within the outer tubular shell, the inner tubular member defining first and second ends and at least one side wall wherein the inner tubular member defines an internal passage forming a first axial flow path, and wherein a space is defined between the least one inner tubular member side wall and the at least one outer tubular shell side wall to form a second axial flow path, wherein the first and second flow paths are coaxial and are in communication with each other adjacent at least one of the ends of the inner tubular member;

a first inlet/outlet in communication with the first flow path and isolated from the second flow path;

a second inlet/outlet in communication with the second flow path and isolated from the first flow path;

a temperature adjusting unit removably mounted to and closing the open second end of the outer tubular shell, including a plurality of first fluid temperature adjusting elements carried thereby and disposed in the first flow path and a plurality of second fluid temperature adjusting elements carried thereby and disposed in the second flow path, wherein the first and second fluid temperature adjusting elements are removed from the first and second flow paths, respectively, by the removal of the temperature adjusting unit from the second end of the outer tubular shell;

wherein the temperature adjusting unit includes an end plate removably mounted to the second end of the outer tubular shell for sealing the second end of the outer tubular shell, wherein the second end of the inner tubular member is spaced from the end plate such that the end plate and the at least one side wall of the outer tubular shell cooperate to define a transfer chamber in the space between the end plate and the second end of the inner tubular member, wherein the transfer chamber is disposed between the first and second flow paths and establishes communication therebetween; and wherein the fluid is introduced through one of the inlet/outlet openings and flows through the first and second flow paths and is discharged through the other of the inlet/outlet openings, wherein the first and second fluid temperature adjusting elements function to alter the temperature of the fluid as the fluid flows through the first and second flow paths.

5. The assembly of claim 4, wherein the plurality of first and second fluid temperature adjusting elements are mounted to the end plate, extending therefrom into the first and second flow paths and terminating at a location spaced from the closed first end of the outer tubular shell.

6. An assembly for heating or cooling a fluid, comprising:

an outer tubular shell defining first and second ends and at least one side wall;

an inner tubular member mounted within the outer tubular shell, the inner tubular member defining first and second ends and at least one side wall, wherein the inner tubular member defines an internal passage forming a first axial flow path, and wherein a space is defined between the at least one inner tubular member side wall and the at least one outer tubular shell side wall to form a second axial flow path, wherein the first and second flow paths are coaxial;

a seal member interposed between the inner tubular member and the outer tubular shell toward the first end of the inner tubular member for cutting off communication between the first and second flow paths;

a first inlet/outlet opening formed in the outer tubular shell in communication with the first flow path through the inlet/outlet chamber and isolated from the second flow path;

a second inlet/outlet opening formed in the outer tubular shell in communication with the second flow path and isolated from the first flow path, the second inlet/outlet opening being located adjacent the seal member;

a first end plate mounted to the first end of the outer tubular shell and spaced from the first end of the inner tubular member, wherein the first end plate, the at least one side wall of the outer tubular shell and the seal member cooperate to define an inlet/outlet chamber located between the first inlet/outlet opening and the first flow path;

a fluid temperature adjusting unit removably mounted to the second end of the outer tubular shell and including a second end plate spaced from the second end of the inner tubular member, wherein the second end plate and the at least one side wall of the outer tubular shell define a transfer chamber located between the first and second flow paths and establishing communication therebetween, the fluid temperature adjusting unit further including a plurality of fluid temperature adjusting elements mounted to and extending from the second end plate, wherein the plurality of fluid temperature adjusting elements include an inner set of fluid temperature adjusting elements disposed in the first flow path and an outer set of fluid temperature adjusting elements disposed in the second flow path, wherein the second end plate and the inner and outer sets of fluid temperature adjusting elements are removed from the first and second flow paths, respectively, by the removal of the temperature adjusting unit from the second end of the outer tubular shell; and wherein fluid is introduced through one of the inlet/outlet openings and flows through the first and second flow paths and is discharged from the other of the inlet/outlet openings, wherein the plurality of fluid temperature adjusting elements function to alter the temperature of the fluid as the fluid flows through the first and second flow paths.

* * * * *